US008814065B2

(12) United States Patent
Iwano et al.

(10) Patent No.: US 8,814,065 B2
(45) Date of Patent: Aug. 26, 2014

(54) NOZZLE UNIT FOR APPLYING DAMPING MATERIAL, AND DAMPING MATERIAL APPLICATION APPARATUS

(75) Inventors: Yoshihiro Iwano, Toyota (JP); Toshifumi Miyagawa, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 308 days.

(21) Appl. No.: 13/322,216

(22) PCT Filed: May 20, 2010

(86) PCT No.: PCT/IB2010/001305
§ 371 (c)(1),
(2), (4) Date: Nov. 23, 2011

(87) PCT Pub. No.: WO2010/136893
PCT Pub. Date: Dec. 2, 2010

(65) Prior Publication Data

US 2012/0067980 A1 Mar. 22, 2012

(30) Foreign Application Priority Data

May 27, 2009 (JP) ..... 2009-127227

(51) Int. Cl.
*B05B 1/26* (2006.01)

(52) U.S. Cl.
USPC ..... 239/512; 239/505; 239/507; 239/509

(58) Field of Classification Search
USPC ..... 239/505, 507, 509, 511, 512
See application file for complete search history.

(56) References Cited

U.S. PATENT DOCUMENTS

| | | | | |
|---|---|---|---|---|
| 4,158,076 | A | 6/1979 | Wallsten | |
| 5,375,479 | A * | 12/1994 | Kouno et al. | 74/420 |
| 5,558,716 | A | 9/1996 | Mitani et al. | |
| 2003/0080307 | A1 * | 5/2003 | Jackson et al. | 251/205 |

FOREIGN PATENT DOCUMENTS

| | | | |
|---|---|---|---|
| CN | 2136321 | Y | 6/1993 |
| CN | 1286363 | A | 3/2001 |
| DE | 103 58 220 | A1 | 7/2005 |
| DE | 10 2007 056121 | B3 | 9/2008 |
| JP | 05-129350 | A | 5/1993 |
| JP | 10-000398 | A | 1/1998 |
| JP | 10-156250 | A | 6/1998 |
| JP | 2000-233151 | A | 8/2000 |
| JP | 2000-334359 | A | 12/2000 |
| JP | 2002-273317 | A | 9/2002 |
| JP | 2003-311188 | A | 11/2003 |
| JP | 2004-202403 | A | 7/2004 |

(Continued)

OTHER PUBLICATIONS

International Search Report and Written Opinion of PCT/IB2010/001305 mailed Jun. 4, 2011.

(Continued)

*Primary Examiner* — Ryan Reis
(74) *Attorney, Agent, or Firm* — Kenyon & Kenyon LLP

(57) ABSTRACT

A nozzle unit for applying damping material onto a work piece includes a nozzle that has a slit-like discharge port and that discharges the damping material from the discharge port; a motor that is fixed to the nozzle; and a slit width changing device that changes the slit width of the discharge port using rotation of the motor.

2 Claims, 13 Drawing Sheets

(56) References Cited

FOREIGN PATENT DOCUMENTS

| | | | |
|---|---|---|---|
| JP | 2004-250632 | A | 9/2004 |
| JP | 2006-239664 | A | 9/2006 |
| JP | 2008-068224 | A | 3/2008 |
| JP | 2008-110271 | A | 5/2008 |
| JP | 2009-006302 | A | 1/2009 |
| JP | 2010-036110 | A | 2/2010 |
| WO | 2004/108392 | A1 | 12/2004 |

OTHER PUBLICATIONS

Office Action issued Feb. 8, 2011 in Japanese Patent Application No. 2009-127227 & English translation thereof.

* cited by examiner

NOZZLE UNIT FOR APPLYING DAMPING MATERIAL, AND DAMPING MATERIAL APPLICATION APPARATUS

This is a 371 national phase application of PCT/IB2010/001305 filed 20 May 2010, claiming priority to Japanese Patent Application No. 2009-127227 filed 27 May 2009, the contents of which are incorporated herein by reference.

BACKGROUND OF THE INVENTION

1. Field of the Invention

The invention relates to a nozzle unit for applying damping material, and a damping material application apparatus.

2. Description of the Related Art

There is known a technique for forming a damping material layer on the surface of a structure that requires vibration damping property. For example, Japanese Patent Application Publication No. 2009-6302 (JP-A-2009-6302) describes that a damping material layer is faulted on a floor panel of an automobile to thereby improve the vibration damping property inside a vehicle cabin. To form the damping material layer, uncured damping material is applied to the surface of a work piece on which a damping material layer is formed. Then, the applied damping material is cured to thereby form the damping material layer on the surface of the work piece.

When the slit width of a discharge port of a nozzle is changed, the thickness of damping material to be applied may be regulated. In JP-A-2009-6302, a spacer is replaced to change the slit width of the discharge port. However, in order to replace the spacer, it is necessary to disassemble the nozzle, so work is complicated.

SUMMARY OF THE INVENTION

The invention provides a nozzle unit that is able to change the slit width of a discharge port of a nozzle using a motor and a damping material application apparatus that is provided with the nozzle unit.

A first aspect of the invention relates to a nozzle unit for applying damping material onto a work piece. The nozzle unit includes: a nozzle that has a discharge port, which has a slit shape, and that discharges the damping material from the discharge port; a motor that is fixed to the nozzle; and a slit width changing device that changes the slit width of the discharge port using rotation of the motor. In this way, the slit width of the discharge port is controlled by the motor, so it is possible to easily regulate the slit width of the discharge port through a program, or the like.

A work piece on which the damping material is applied often has a complex shape. Therefore, if the motor is secured to the nozzle, there is a possibility that the motor interferes with the work piece and then it is difficult to apply the damping material. Particularly, the motor has a large size in the direction of the rotary shaft. For this reason, when the first rotary shaft of the motor is directly connected to a mechanism that regulates the slit width of the discharge port of the nozzle, the motor is secured to the nozzle in a state where the motor extremely protrudes from the side face of the nozzle. Therefore, the motor easily interferes with the work piece, and an area in which the damping material may be applied is reduced. Thus, the above described nozzle unit may be configured as follows.

In the above configuration, the nozzle unit may further include a rotation transmitting device, the motor may be arranged in such an orientation that a first rotary shaft of the motor is aligned in a direction in which the damping material is discharged from the nozzle, the rotation transmitting device may transmit rotation of the first rotary shaft to a second rotary shaft that extends toward the nozzle, and the slit width changing device may change the slit width of the discharge port in accordance with rotation of the second rotary shaft. In this nozzle unit, the motor is fixed to the nozzle in such an orientation that the first rotary shaft of the motor extends in a direction in which the damping material is discharged. The size of the motor in the direction perpendicular to the first rotary shaft is not so large. Thus, the motor is fixed to the nozzle in this way, so the motor does not extremely protrude from the side face of the nozzle. Therefore, when the damping material is applied, it is less likely that the motor interferes with the work piece. In addition, rotation of the first rotary shaft of the motor is transmitted to the second rotary shaft, extending toward the nozzle, via the rotation transmitting device. The slit width changing device changes the slit width of the discharge port using rotation of the second rotary shaft. Therefore, by controlling the motor, the slit width of the discharge port of the nozzle may be controlled.

In the above configuration, the rotation transmitting device may transmit rotation of the first rotary shaft to the second rotary shaft so that the rotational speed of the second rotary shaft is lower than the rotational speed of the first rotary shaft of the motor. With the above configuration, the rotation angle of the second rotary shaft may be smaller than the rotation angle of the rotary shaft of the motor, so it is possible to further minutely regulate the slit width of the discharge port of the nozzle when the operation of the motor is controlled.

A second aspect of the invention relates to a damping, material application apparatus. The damping material application apparatus includes: a nozzle unit for applying damping material onto a work piece, wherein the nozzle unit includes a nozzle that has a discharge port, which has a slit shape, and that discharges the damping material from the discharge port; a motor that is fixed to the nozzle; and a slit width changing device that changes the slit width of the discharge port using rotation of the motor; an actuator that moves the nozzle unit with respect to the work piece; and a controller that controls the nozzle unit and the actuator, wherein the controller receives a target thickness of applied damping material, a control target value of the slit width of the discharge port of the nozzle, a control target value of a discharge speed of the damping material, and a control target value of a relative travel speed between the nozzle and the work piece in a direction of the slit width of the nozzle, determines whether a difference between the target thickness and a predicted thickness of the applied damping material, calculated from the control target value of the slit width, the control target value of the discharge speed and the control target value of the relative travel speed, falls within an allowable range, and controls the nozzle unit and the actuator on the basis of the control target value of the slit width, the control target value of the discharge speed and the control target value of the relative travel speed when the difference falls within the allowable range. Note that the control target value of the slit width of the discharge port of the nozzle may not concretely specify the slit width. For example, it may be a control target value that specifies the rotational position of the motor. In addition, the control target value of the discharge speed may not concretely specify the discharge speed. For example, it may be a control target value that specifies a feeding pressure at which the damping material is fed to the nozzle. In addition, the control target value of the relative travel speed between the nozzle and the work piece in the direction of the slit width of the nozzle may not concretely specify the relative travel speed. For example, it may be a control target value that specifies the rotational speed of the motor, or the like, used for relative travel. In this way, the above control target values not only include the ones that directly specify the respective values but also the ones that specify parameters that influence the respective values. With the damping material application apparatus, the damping material is applied when the target thickness of the damping material and a predicted thickness of the damping material, predicted from the control target values, fall within the allowable range. This prevents a situation that the damping material is applied in accordance with erroneous control target values.

The above described damping material application apparatus may further include a thickness measuring device that measures the thickness of the applied damping material, wherein, during application of the damping material, the controller may change at least one of the control target value of the slit width of the discharge port of the nozzle, the control target value of the discharge speed of the damping material and the control target value of the relative travel speed between the nozzle and the work piece in the direction of the slit width of the nozzle on the basis of a difference between the target thickness and the thickness measured by the thickness measuring device. With the above configuration, the thickness of the damping material may be further accurately controlled.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
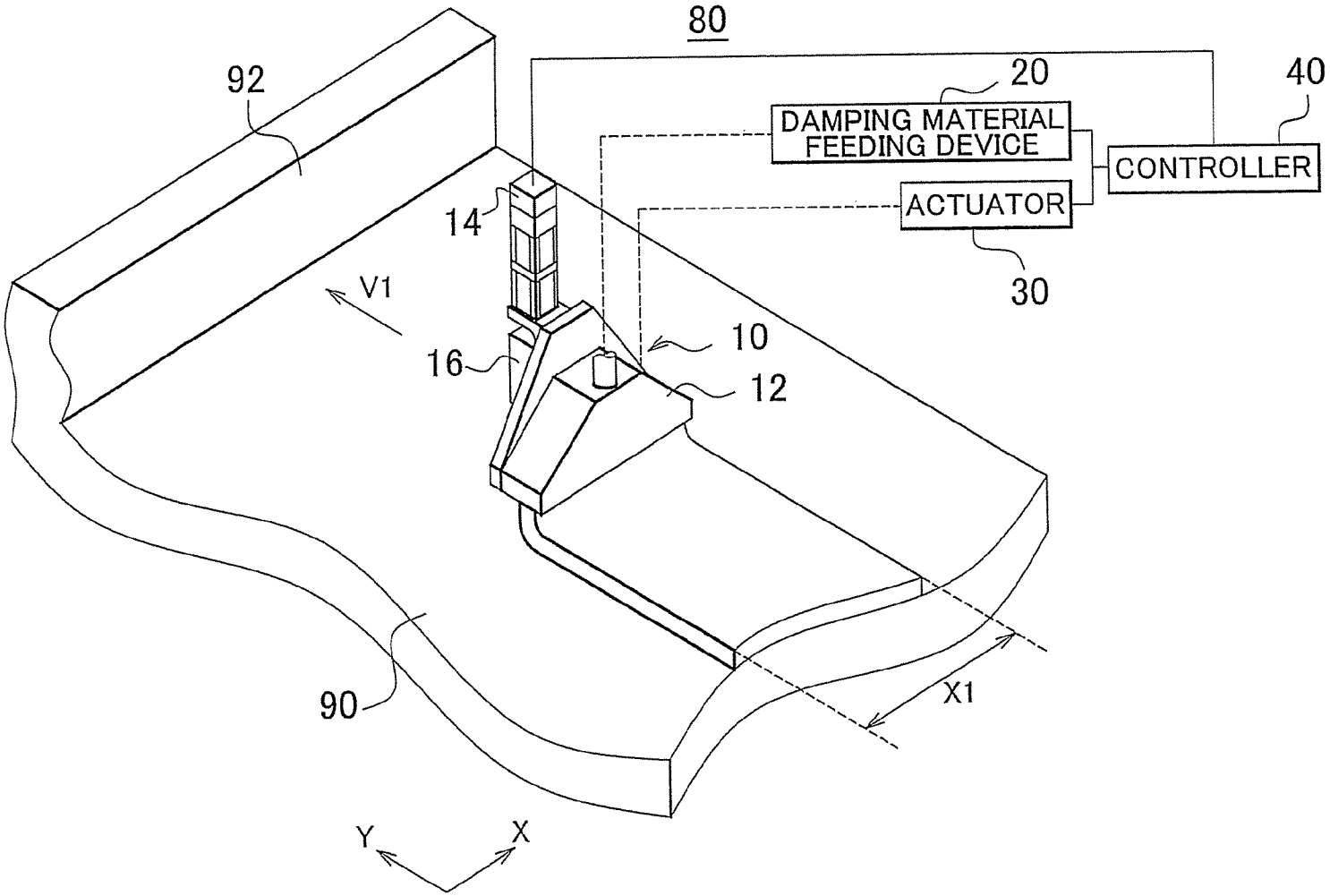
FIG. 1 is a view that shows the configuration of a damping material application apparatus.

A damping material application apparatus according to an embodiment of the invention will be described. FIG. 1 shows a state where damping material is applied onto a work piece 90 by a damping material application apparatus 80 according to the embodiment. As shown in the drawing, the damping material application apparatus 80 includes a nozzle unit 10, a damping material feeding device 20, an actuator 30 and a controller 40.

Figure 2:
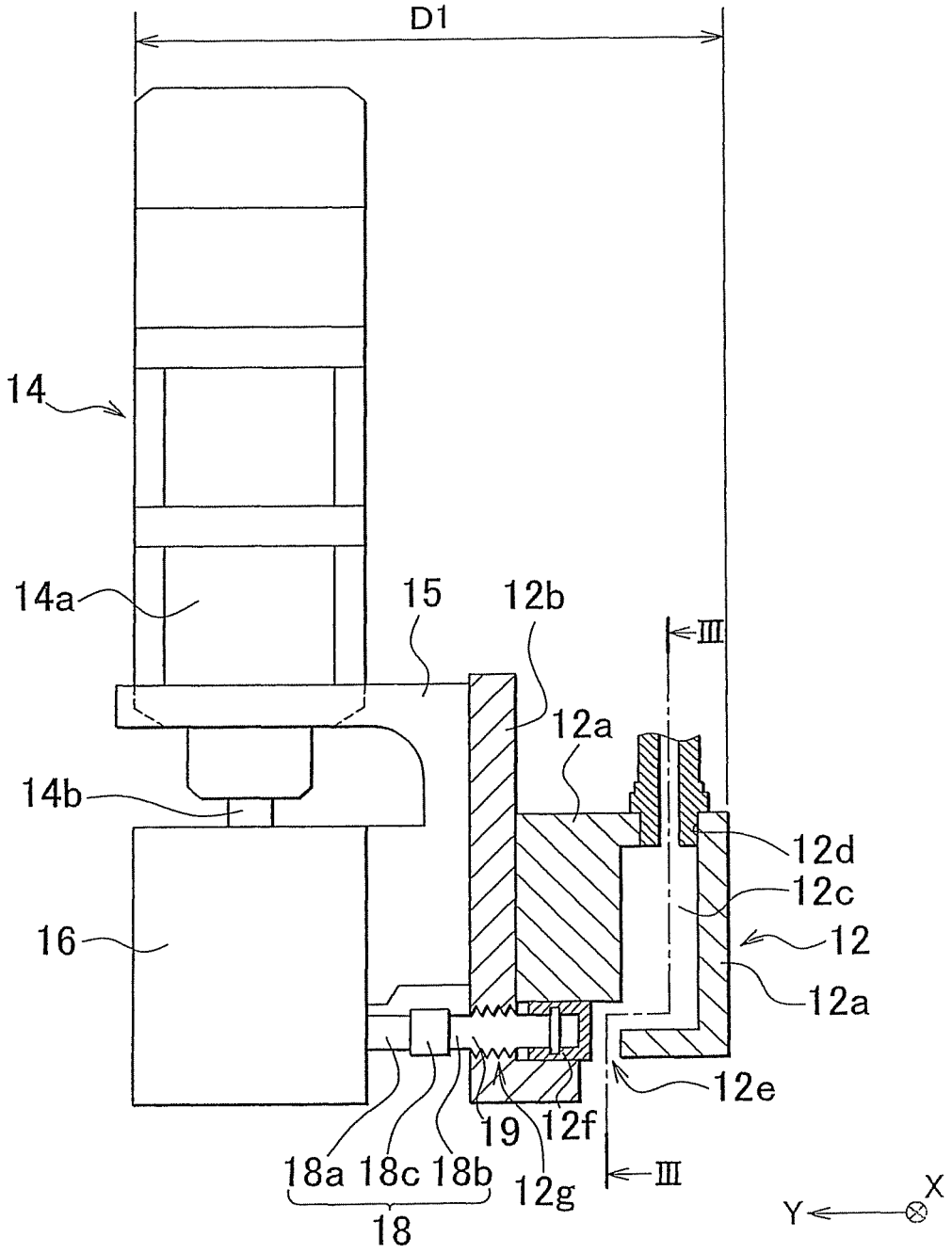
FIG. 2 is a view that shows a nozzle unit as viewed in the X direction in FIG. 1.
Figure 3:
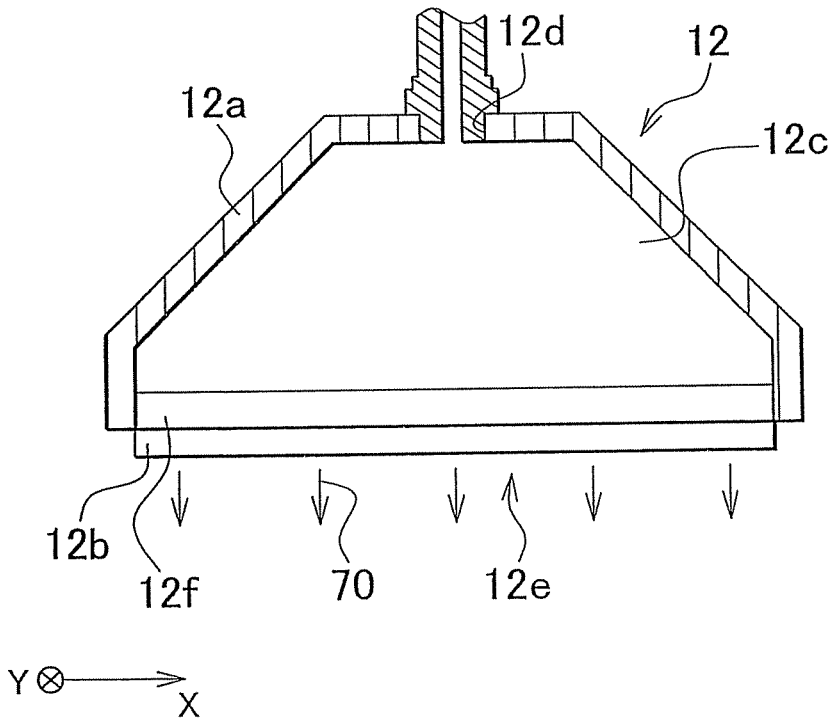
FIG. 3 is a cross-sectional view taken along the line III-III in FIG. 2 as viewed in the direction of the arrows.
Figure 4:
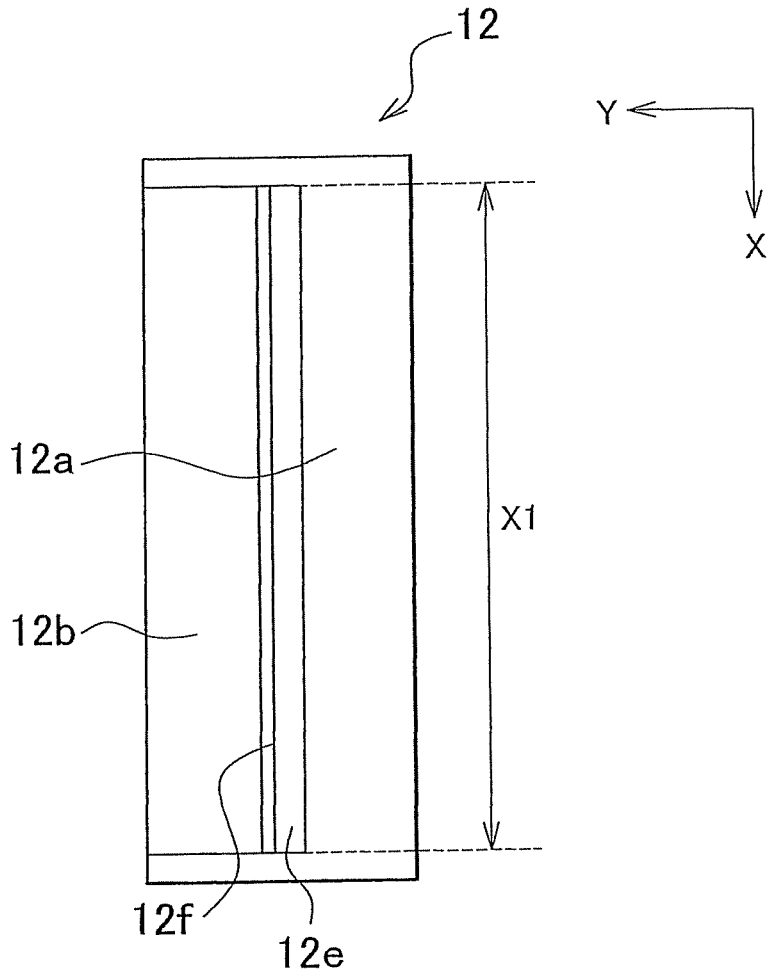
FIG. 4 is a bottom view of the nozzle.

FIG. 2 shows the nozzle unit 10 as viewed in the X direction in FIG. 1. As shown in FIG. 2, the nozzle unit 10 includes a nozzle 12, a servo motor 14 and a gear box 16. FIG. 2 shows the cross-sectional view of the nozzle 12. FIG. 3 shows a longitudinal cross-sectional view of the nozzle 12, taken along the line III-III in FIG. 2, as viewed in plan view in a direction indicated by the arrows. FIG. 4 shows a plan view of the nozzle 12 as viewed from the bottom side.

As shown in FIG. 2 to FIG. 4, the nozzle 12 is formed of a case 12*a* and a case 12*b* that is fixed to the case 12*a*. As shown in FIG. 2 and FIG. 3, an internal space 12*c* is formed inside the nozzle 12. The width of the internal space 12*c* in the X direction widens from the upper side toward the lower side. As shown in FIG. 3, a feeding port 12*d* is formed at the upper end of the case 12*a*. The feeding port 12*d* is in fluid communication with the internal space 12*c*. The feeding port 12*d* is connected to a damping material feeding device 20, shown in FIG. 1, via a pipe line. Although it will be described later, damping material is fed from the damping material feeding device 20 to the feeding port 12*d*. As shown in FIG. 2 to FIG. 4, a discharge port 12*e* is formed at the bottom of the nozzle 12. The discharge port 12*e* is in fluid communication with the internal space 12*c*. As shown in FIG. 3 and FIG. 4, the discharge port 12*e* is a slit-like opening that has a substantially uniform width in the Y direction (direction perpendicular to the X direction) and that extends straight in the X direction. The damping material fed to the feeding port 12*d* passes through the internal space 12*c* and is discharged from the discharge port 12*e* to the outside of the nozzle 12. As shown in FIG. 2, one of wall surfaces of the discharge port 12*e* in the Y direction is formed of a movable block 12*f*. The movable block 12*f* is slidable in the Y direction with respect to the case 12*a*. By sliding the movable block 12*f*, the width of the discharge port 12*e* in the Y direction (that is, the slit width) is changed. In addition, as shown in the arrows 70 in FIG. 3, the nozzle 12 is designed so that damping material is discharged straight from the discharge port 12*e*. That is, damping material to be discharged is designed not to spread in the X direction.

As shown in FIG. 2, the servo motor 14 includes a case 14*a* and a rotary shaft 14*b*. A rotor is rotatably accommodated inside the case 14*a*. The rotary shaft 14*b* is a rotary shaft of the rotor. As electric power is supplied to the servo motor 14, the rotary shaft 14*b* rotates with respect to the case 14*a*. Although not shown in the drawing, the servo motor 14 has a built-in rotary encoder. As shown in FIG. 1, the servo motor 14 is electrically connected to the controller 40. The rotational speed of the servo motor 14 detected by the rotary encoder is input to the controller 40. The controller 40 controls the servo motor 14 on the basis of the input rotational speed. Thus, the rotational speed of the servo motor 14 is accurately controlled by the controller 40. As shown in FIG. 2, the case 14*a* of the servo motor 14 is fixed to the side surface of the nozzle 12 via a connecting member 15. The servo motor 14 is secured to the nozzle 12 in such an orientation that the rotary shaft 14*b* extends downward from the case 14*a* (that is, in a direction in which damping material is discharged).

The gear box 16 is fixed to the side surface of the nozzle 12 via the connecting member 15. The gear box 16 incorporates a plurality of gears. The gears inside the gear box 16 include a gear, such as a bevel gear, that converts the direction of a rotary shaft. The gear box 16 is connected to the rotary shaft 14*b* of the servo motor 14, and is also connected to the rotary shaft 18 that is arranged in an orientation perpendicular to the rotary shaft 14*b*. The gear box 16 transmits the rotation of the rotary shaft 14*b* to the rotary shaft 18 via the internal gears. Thus, as the rotary shaft 14*b* rotates, the rotary shaft 18 rotates. The gear ratio of the internal gears of the gear box 16 is set so as to reduce the rotation of the rotary shaft 14*b* and then transmit the rotation to the rotary shaft 18. That is, the rotational speed of the rotary shaft 18 is lower than the rotational speed of the rotary shaft 14*b*.

The rotary shaft 18 extends from the gear box 16 toward the nozzle 12. The rotary shaft 18 is formed of a first rotary shaft 18*a*, a second rotary shaft 18*b* and a connecting member 18*c*. The rotary shaft 18*a* is connected to the gear box 16. The rotary shaft 18*b* is connected to the rotary shaft 18*a* via the connecting member 18*c*. The connecting member 18*c* connects the rotary shaft 18*b* to the rotary shaft 18*a* so that the rotary shaft 18*b* is slidable in the axial direction (that is, Y direction) with respect to the rotary shaft 18*a* and the rotary shaft 18*b* is not rotatable with respect to the rotary shaft 18*a*. The rotary shaft 18*b* is inserted in a threaded hole 12*g* formed in the case 12*b*. A threaded portion 19 is formed on part of the side surface of the rotary shaft 18*b*. The threaded portion 19 of the rotary shaft 18*b* is engaged with the threaded hole 12*g*. The distal end of the rotary shaft 18*b* is engaged with the movable block 12*f*. The rotary shaft 18*b* is rotatable with respect to the movable block 12*f* and is not slidable with respect to the movable block 12*f*. As the rotary shaft 18 rotates, the threaded portion 19 of the rotary shaft 18*b* is guided by the threaded hole 12*g*, and then the rotary shaft 18*b* moves in the Y direction. By so doing, the movable block 12*f* moves in the Y direction to thereby change the slit width of the discharge port 12*e* of the nozzle 12.

The damping material feeding device 20 is connected to the feeding port 12*d* of the nozzle 12 via the pipe line. The damping material feeding device 20 feeds uncured damping material to the nozzle 12. The damping material, which is fed to the nozzle 12 by the damping material feeding device 20, passes through the internal space 12*c* of the nozzle 12 and is discharged from the discharge port 12*e*. The damping material, feeding device 20 is electrically connected to the controller 40.

The actuator 30 is an industrial robot that has a multiple articulated arm and that drives the articulations by servo motors. The nozzle unit 10 is fixed to the distal end of the arm of the actuator 30. The nozzle unit 10 may be moved with respect to a work piece 90 using the actuator 30. The actuator 30 is electrically connected to the controller 40.

The controller 40 controls the operations of the servo motor 14 of the nozzle unit 10, damping material feeding device 20 and actuator 30.

Next, the thickness of the damping material applied by the damping material application apparatus 80 will be described. As shown in FIG. 1, when damping material is applied, the nozzle 12 is moved in the Y direction by the actuator 30 while the damping material feeding device 20 is operated to discharge damping material from the nozzle 12. By so doing, damping material is applied onto the work piece 90. The damping material application apparatus 80 according to the present embodiment operates so as to satisfy the relationship V1≥V2 where V1 denotes the travel speed of the nozzle 12 in the Y direction and V2 denotes the discharge speed of damping material from the nozzle 12.

Figure 5:
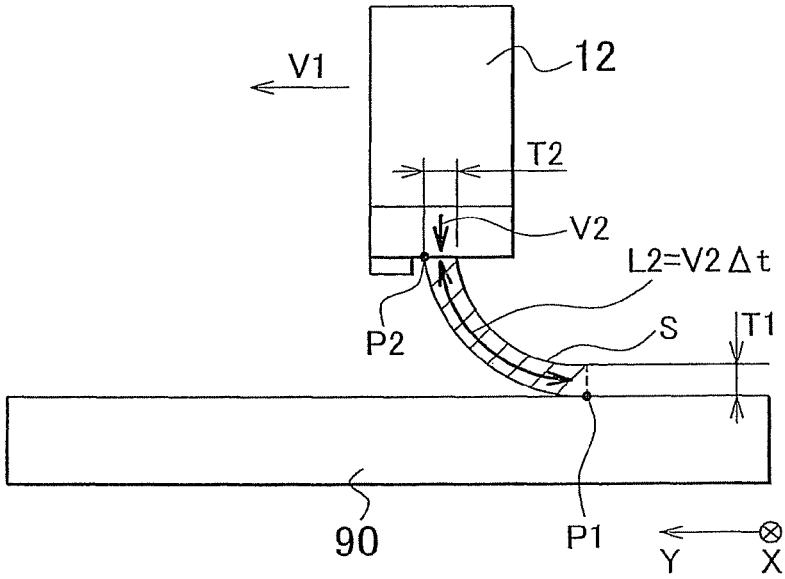
FIG. 5 is a view that illustrates damping material that is being applied at time t0.
Figure 6:
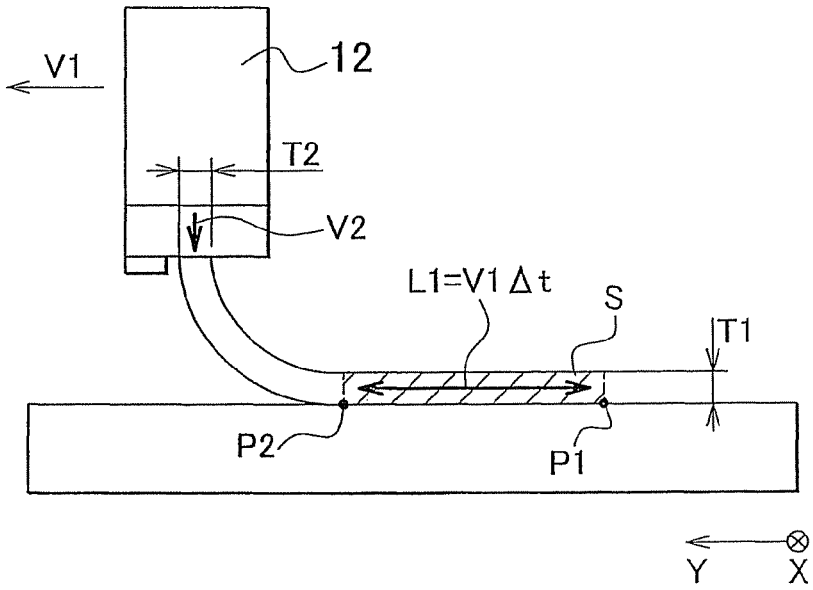
FIG. 6 is a view that illustrates damping material that is being applied at time t0+Δt.

FIG. 5 and FIG. 6 are views that illustrate processes of applying damping material in a state where V1=V2. In FIG. 5 and FIG. 6, a width T1 indicates the thickness of damping material applied on the work piece 90, and a width T2 indicates the slit width of the discharge port 12*e* of the nozzle 12.

FIG. 5 shows a state at time t0. In the example of FIG. 5, damping material contacts the work piece 90 Δt seconds after being discharged from the nozzle 12. The point P1 in FIG. 5 indicates damping material that has been discharged from the nozzle 12 Δt seconds before time t0. Because the damping material has been discharged Δt seconds before, the damping material at the point P1 is located at a boundary between the damping material that is not in contact with the work piece 90 and the damping material that is in contact with the work piece 90. In addition, the point P2 in FIG. 5 indicates damping material present at the discharge port 12*e* of the nozzle 12 at time t0 (that is, damping material at the instant of discharge). The area S in FIG. 5 indicates damping material that is present between the point P1 and the point P2. That is, the damping material in the area S is damping material that has been discharged from the nozzle 12 for Δt seconds immediately before time t0. Thus, the length L2 in FIG. 5 is a product of V2 and Δt, that is, V2Δt. As shown in FIG. 4, where the length X1 of the discharge port 12*e* of the nozzle 12 in the X direction is X1, the volume C2 of damping material discharged from the discharge port 12*e* for Δt seconds in the example of FIG. 5 (that is, damping material indicated by the area S) is expressed by the following mathematical expression 1.

$$C2=X1\cdot T2\cdot L2=X1\cdot T2\cdot V2\cdot\Delta t \quad (1)$$

Figure 16:
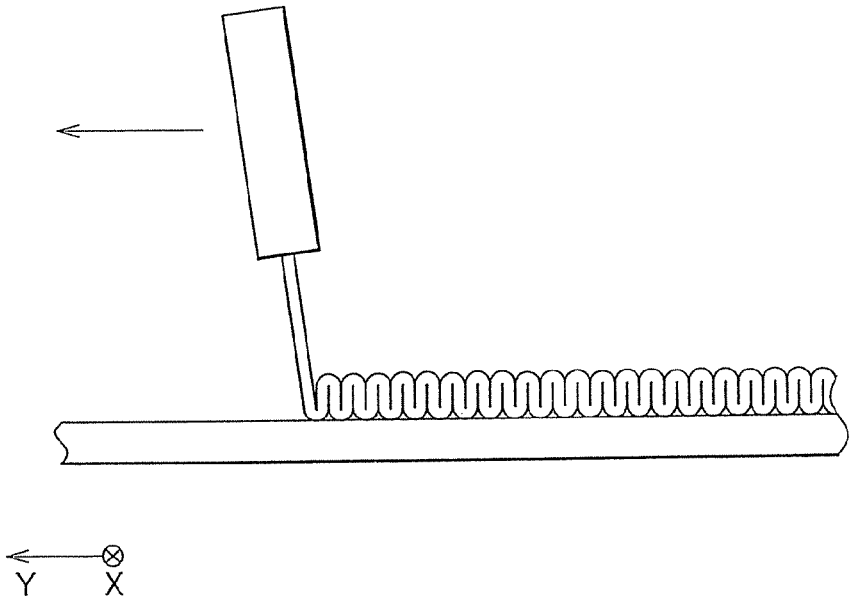
FIG. 16 RELATED ART
FIG. 16 is a view that shows a damping material, application method according to a related art, in which, when a nozzle having a slit-like discharge port extending in the X direction is moved in the Y direction while discharging damping material to thereby apply the damping material, the nozzle is moved at a travel speed lower than a discharge speed of the damping material.

FIG. 6 shows a state where Δt seconds (a period of time equal to the above Δt seconds) have further elapsed from time t0. In this state, the damping material at the point P2 is located at a boundary between damping material that is not in contact with the work piece 90 and damping material that is in contact with the work piece 90. The distance L1 between the point P1 and the point P2 is equal to a distance that the nozzle 12 has moved for Δt seconds. Thus, the distance L1 is V1Δt. When the distance L2 shown in FIG. 5 is longer than the distance L1 shown in FIG. 6, damping material is applied so as to be folded as shown in FIG. 16. The damping material application apparatus 80 operates so as to satisfy the relationship V1≥V2, so the relationship L1≥L2 is satisfied. Thus, damping material is applied without folding the damping material. Note that, in the examples of FIG. 5 and FIG. 6, V1=V2, so L1=L2; therefore, applied damping material is not folded. When damping material is not folded, the volume C1 of the damping material indicated by the area S in FIG. 6 may be obtained as follows. That is, as described above, damping material is discharged from the nozzle 12 so as not to spread in the X direction, so, as shown in FIG. 1, the width of applied damping material is substantially equal to the length X1 of the discharge port 12*e* in the X direction. Thus, the volume C1 of the damping material indicated by the area S in FIG. 6 is expressed by the following mathematical expression 2.

$$C1=X1\cdot T1\cdot L1=X1\cdot T1\cdot V1\cdot\Delta t \quad (2)$$

Because the volume C1 is equal to the volume C2, the following mathematical expression 3 is obtained from the mathematical expression 1 and the mathematical expression 2.

$$T1=T2\cdot V2/V1 \quad (3)$$

Note that, in the examples of FIG. 5 and FIG. 6, the travel speed V1 is equal to the discharge speed V2, so the thickness T1 is equal to the slit width T2. The slit width T2 of the discharge port 12*e*, the travel speed V1 and the discharge speed V2 are parameters that may be controlled by the damping material application apparatus 80. Thus, the thickness T1 of applied damping material may be predicted from the control parameters of the damping material application apparatus 80. Note that a value calculated from the mathematical expression 3 is a theoretical value and may have a slight error as compared with an actual value. Thus, the thickness T1 of damping material may be predicted from the a correlation, or the like, based on historical data between the control parameters and the thickness T1.

Figure 7:
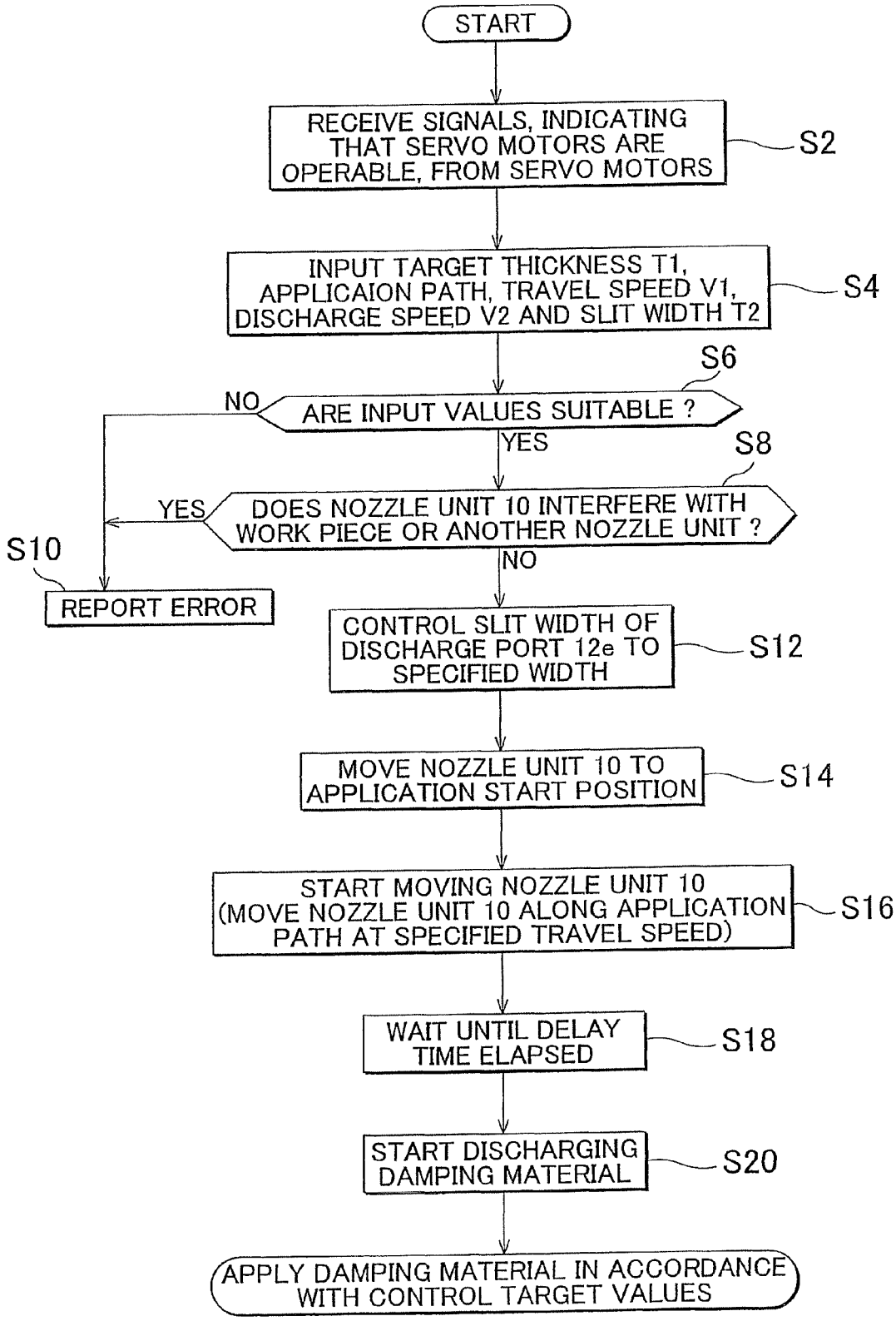
FIG. 7 is a flowchart that shows the process executed by a controller at the time when application of damping material is started.

Next, the operation of the damping material application apparatus 80 will be described. FIG. 7 is a flowchart that shows the process executed by the controller 40 at the time when the damping material application apparatus 80 starts operation. When the damping material application apparatus 80 is operated, the controller 40 receives signals, indicating that the servo motor 14 and the servo motors of the actuator 30 are operable, from the servo motor 14 and the servo motors of the actuator 30 in step S2. As the controller 40 receives signals, indicating that all the servo motors are operable, from all the servo motors, the controller 40 executes step S4.

In step S4, the controller 40 receives a target thickness of damping material to be applied, an application path along which damping material is applied on the work piece 90, a control target value of the travel speed V1 of the nozzle 12, a control target value of the discharge speed V2 of damping material and a control target value of the slit width T2 of the discharge port 12*e*. Note that the pressure at which the damping material feeding device 20 feeds damping material to the nozzle 12 correlates with the discharge speed V2 of damping material. Thus, in step S4, a control target value of the feeding pressure of damping material may be input. As a user inputs these pieces of data, the controller 40 executes step S6.

In step S6, the controller 40 determines whether the values input in step S4 are suitable. That is, the controller 40 determines whether the target thickness T0, the control target value of the travel speed V1, the control target value of the discharge speed V2 and the control target value of the slit width T2 fall within suitable ranges. In addition, it is determined whether the control target value of the travel speed V1 and the control target value of the discharge speed V2 satisfy the relationship V1 V2. Furthermore, the controller 40 predicts the thickness of damping material to be applied on the basis of the control target value of the travel speed V1, the control target value of the discharge speed V2 and the control target value of the slit width T2. The thickness may be predicted from the above described mathematical expression 3. Alternatively, the thickness may be predicted on the basis of historical data. The controller 40 determines whether a difference between the predicted thickness and the target thickness falls within a predetermined suitable range. When the input values are not suitable, the controller 40 reports an error in step S10. This prevents the damping material application apparatus 80 from operating on the basis of the erroneously input control target values. When the input values are suitable, the controller 40 executes step S8.

In step S8, the controller 40 checks whether the nozzle unit 10 interferes with the work piece 90 when the nozzle unit 10 is moved along the application path input in step S4. In addition, when a plurality of the damping material application apparatuses 80 are used to apply damping material, the controller 40 also checks whether the nozzle unit 10 interferes with another nozzle unit 10. When the nozzle unit 10 interferes with the work piece 90 or another nozzle unit 10, the controller 10 reports an error in step S8. When the nozzle unit 10 does not interfere with the work piece 90 or another nozzle unit 10, the controller 40 executes step S12.

In step S12, the slit width T2 of the discharge port 12*e* is controlled in accordance with the control target value of the slit width T2 of the discharge port 12*e*, input in step S4. That is, the controller 40 drives the servo motor 14 to regulate the position of the movable block 12*f*. By so doing, the slit width T2 of the discharge port 12*e* is adjusted to a value specified by the control target value.

In step S14, the controller 40 moves the nozzle unit 10 to an application start position. In step S16, the controller 40 moves the nozzle unit 10 along the application path input in step S4 in accordance with the control target value of the travel speed V1, input in step S4. That is, the nozzle unit 10 is moved at the travel speed V1 in the direction of the slit width of the discharge port 12*e* (that is, Y direction) in a state where a certain clearance is held between the nozzle unit 10 and the work piece 90. In this stage, damping material is not yet discharged from the nozzle unit 10.

In step S18, the controller 40 waits until a predetermined delay time elapses in a state where movement of the nozzle unit 10 is continued. The delay time is an extremely short period of time. As the delay time elapses, the controller 40 discharges damping material from the nozzle unit 10 in accordance with the control target value of the discharge speed V2, input in step S4. In this way, damping material is discharged after a lapse of the delay time from a start of movement of the nozzle unit 10, so damping material is prevented from being discharged in a state where the nozzle unit 10 is stopped. This prevents a situation that damping material is locally applied thick at the application start position on the work piece 90. After damping material has been started to be discharged, respective portions are controlled in accordance with the control target values input in step S4, and then damping material is applied along the application path. Because the travel speed V1 and the discharge speed V2 satisfy the relationship V1≥V2, damping material is applied onto the work piece 90 without being folded. In addition, the thickness and target thickness of damping material, predicted from the control target values, are substantially equal to each other, so damping material is applied at the thickness that is substantially equal to the target thickness. In this way, with the damping material application apparatus 80, it is possible to apply damping material while accurately controlling the thickness of damping material.

It is less likely that the above described nozzle unit 10 interferes with the work piece 90, or the like, when the nozzle unit 10 applies damping material. That is, as described above, in the nozzle unit 10, the servo motor 14 is fixed to the nozzle 12 so that the rotary shaft 14*b* is parallel to the direction in which damping material is discharged. Therefore, the width D1 of the nozzle unit 10 in the Y direction shown in FIG. 2 is not so large. If the rotary shaft 14*b* of the servo motor 14 is directly connected to the rotary shaft 18, the servo motor 14 is arranged so as to protrude from the side face of the nozzle 12 in the Y direction by a large amount. Therefore, the width D1 of the nozzle unit 10 is extremely large, so the nozzle unit 10 easily interferes with a work piece, or the like. In the nozzle unit 10 according to the present embodiment, the servo motor 14 is fixed to the nozzle 12 so that the rotary shaft 14*b* is parallel to the direction in which damping material is discharged, so compactness of the nozzle unit 10 is achieved. Because the nozzle unit 10 is compact, it is less likely that the nozzle unit 10 interferes with the work piece 90. For example, as shown in FIG. 1, even when a bent portion 92 is formed in the work piece 90, damping material may be applied to the vicinity of the bent portion 92.

In addition, as described above, with the damping material application apparatus 80 according to the present embodiment, damping material may be applied onto the work piece 90 without being folded in a wavy shape. When applied damping material is folded in a wavy shape, a large amount of air bubbles are entrapped in the applied damping material. With the damping material application apparatus 80, it is possible to suppress entrapment of air bubbles in applied damping material. In addition, when applied damping material is folded in a wavy shape as shown in FIG. 16, unevenness is formed on the surface of the applied damping material in the Y direction. That is, the thickness of the applied damping material varies depending on the position in the Y direction. With the damping material application apparatus 80 according to the present embodiment, because applied damping material is not folded in a wavy shape, variations in the thickness of damping material depending on the position are considerably small. With the damping material application apparatus 80, damping material may be applied at a uniform thickness. In addition, the damping material application apparatus 80 is able to accurately regulate the width of the discharge port 12*e* of the nozzle 12 by the servo motor 14. Particularly, the gear ratio of the gear box 16 is set so that the rotational speed of the rotary shaft 18 is slower than the rotational speed of the rotary shaft 14*b*, so the slit width of the discharge port 12*e* may be further accurately regulated. Thus, the thickness of damping material to be applied may be accurately controlled.

Figure 8:
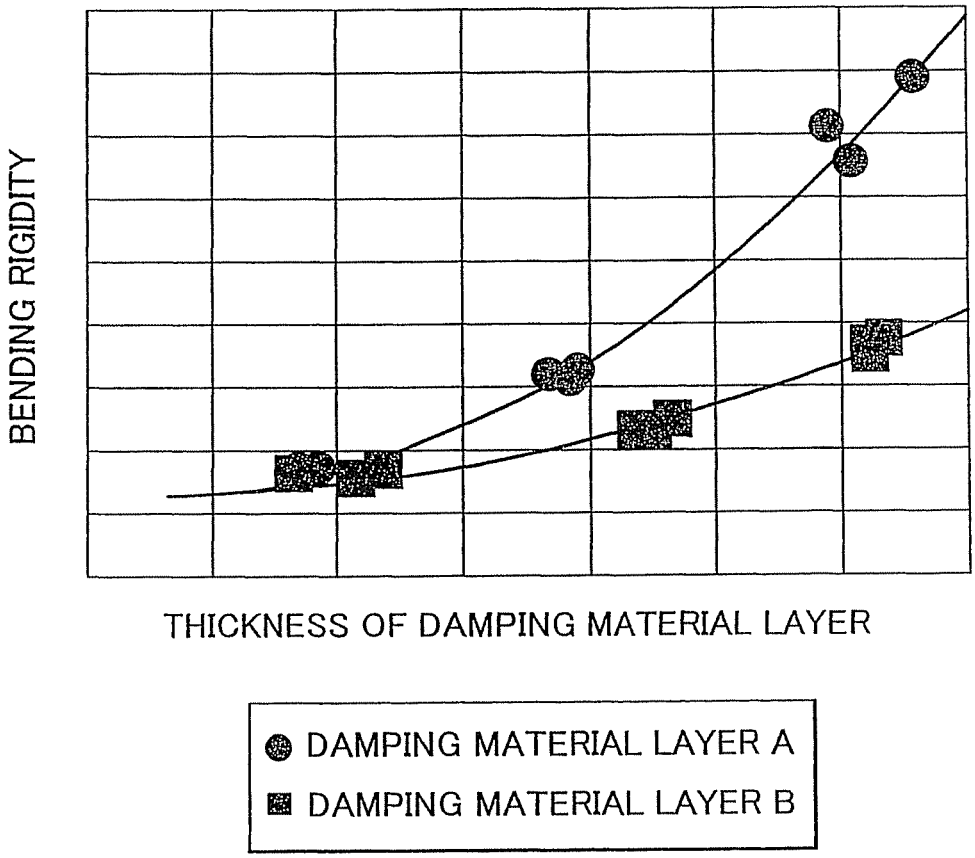
FIG. 8 is a graph that shows the bending rigidities of damping material layers A and B.

The thus applied damping material is cured by heating. The characteristics of a cured damping material layer will be described below. FIG. 8 shows the bending rigidity of a damping material layer A that is applied by the damping material application apparatus 80 according to the present embodiment and the bending rigidity of a damping material layer B that is applied with being folded in a wavy shape as shown in FIG. 16. In this test, the bending rigidities of a plurality of the damping material layers A and B having different thicknesses were measured. As shown in FIG. 8, at any thickness, the bending rigidity of the damping material layer A is higher than the bending rigidity of the damping material layer B. In addition, it appears that, as the thickness increases, a difference in bending rigidity between the damping material layers A and B becomes remarkable. It is presumable that the reason why the bending rigidity of the damping material layer A is higher than the bending rigidity of the damping material layer B is because air bubbles present in the damping material layer A are fewer than those in the damping material layer B.

Figure 9:
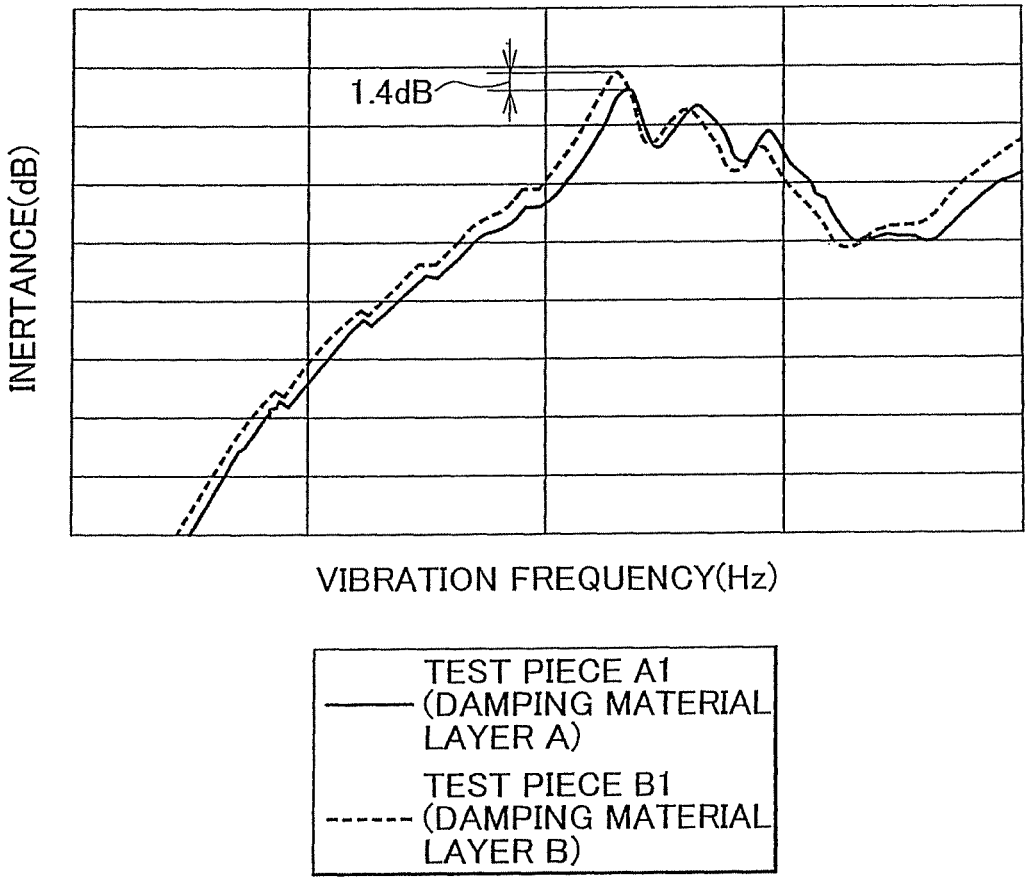
FIG. 9 is a graph that shows the inertances of test pieces A1 and B1 in vibration tests.

FIG. 9 shows the results of vibration tests through simulation (CAE) on a test piece A1 in which the damping material layer A is formed on a work piece and a test piece B1 in which the damping material layer B is formed on a work piece. Note that the thicknesses of the work pieces and the thicknesses of the damping material layers are equal between the test piece A1 and the test piece B1. The abscissa axis of FIG. 9 represents vibration frequency, and the ordinate axis of FIG. 9 represents inertance during vibration. Note that the inertance is a value expressed by A/F where an input force is F and an acceleration at a measured point is A. A high inertance means that high vibrations (noise) are occurring (that is, vibration damping performance is low). As shown in FIG. 9, when the test piece A1 and the test piece B1 are compared with each other, the inertance of the test piece A1 is lower than the inertance of the test piece B1 in an almost all the frequency range except part of the frequency range. Particularly, the peak value of inertance is significant in an automobile, and, as shown in FIG. 9, the results show that the peak value of inertance of the test piece A1 is lower by about 1.4 dB than the peak value of inertance of the test piece B1. The reason why the inertance of the test piece A1 is lower than the inertance of the test piece B1 (that is, vibration damping performance is high) is presumably because air bubbles contained in the damping material layer A are few and the rigidity of the damping material layer A is high.

Figure 10:
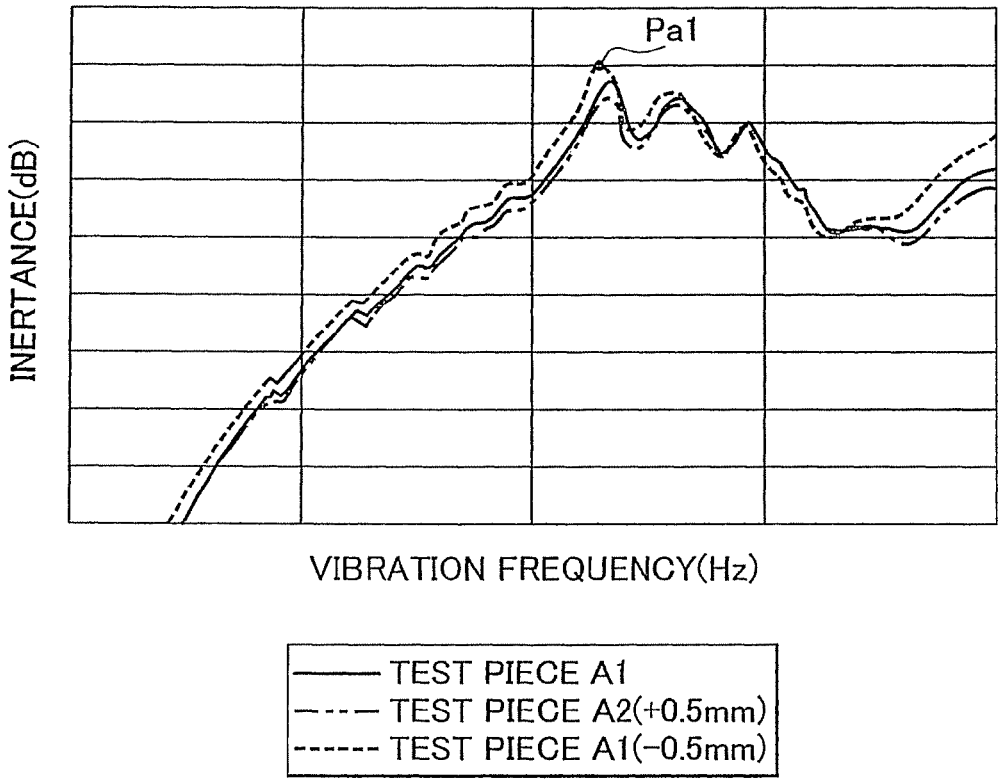
FIG. 10 is a graph that shows the inertances of test pieces A1 to A3 in vibration tests.
Figure 11:
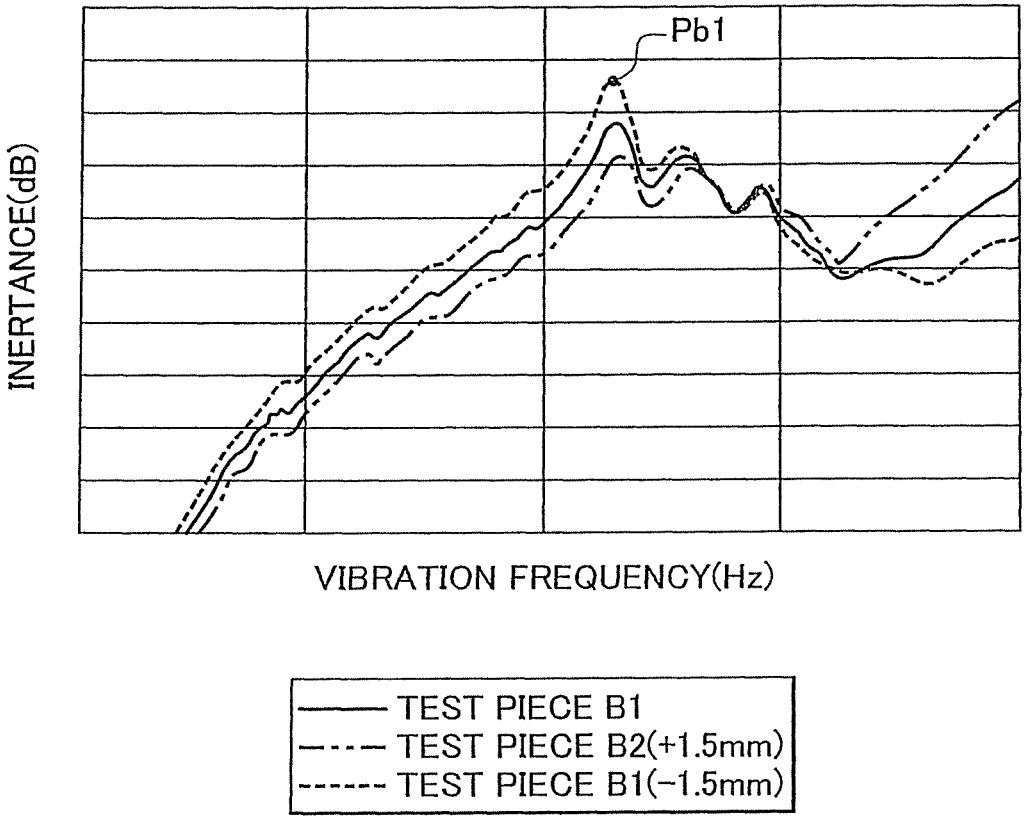
FIG. 11 is a graph that shows the inertances of test pieces B1 to B3 in vibration tests.

In addition, it is also known that variations in thickness of a damping material layer influence the vibration damping performance of the damping material layer. FIG. 10 and FIG. 11 show the results of vibration tests, similar to those of FIG. 9, on a plurality of test pieces having different thicknesses of the damping material layers A and B. As described above, variations in thickness of the damping material layer A that is formed using the damping material application apparatus 80 according to the present embodiment are small. In consideration of manufactured results in the related technical field, variations in thickness, which occur in the damping material layer B, are about 1.5 mm. In contrast, in the damping material layer A, variations in thickness may be suppressed to about 0.5 mm. The present tests are to evaluate vibration damping performance depending on variations in thickness of each of the damping material layers A and B. That is, FIG. 10 shows the results of tests, similar to those of FIG. 9, on the test piece A1, a test piece A2 of which the thickness of the damping material layer A is increased by 0.5 mm from that of the test piece A1, and a test piece A3 of which the thickness of the damping material layer A is reduced by 0.5 mm from that of the test piece A1. In addition, FIG. 11 shows the results of tests, similar to those of FIG. 9, on the test piece B1, a test piece B2 of which the thickness of the damping material layer B is increased by 1.5 mm from that of the test piece B1, and a test piece B3 of which the thickness of the damping material layer A is reduced by 1.5 mm from that of the test piece B1. As is apparent through a comparison between FIG. 10 and FIG. 11, variations in inertance of the test pieces A1 to A3 are apparently smaller than variations in inertance of the test pieces B1 to B3. Particularly, when the peak values of the inertances are checked, the peak value Pa1 of the test piece A3 in FIG. 10 is smaller by about 3.6 dB than the peak value Pb1 of the test piece B3 in FIG. 11. In this way, variations in thickness of a damping material layer are reduced by the damping material application method according to the present embodiment are reduced to thereby improve the vibration damping performance of the damping material layer.

Figure 12:
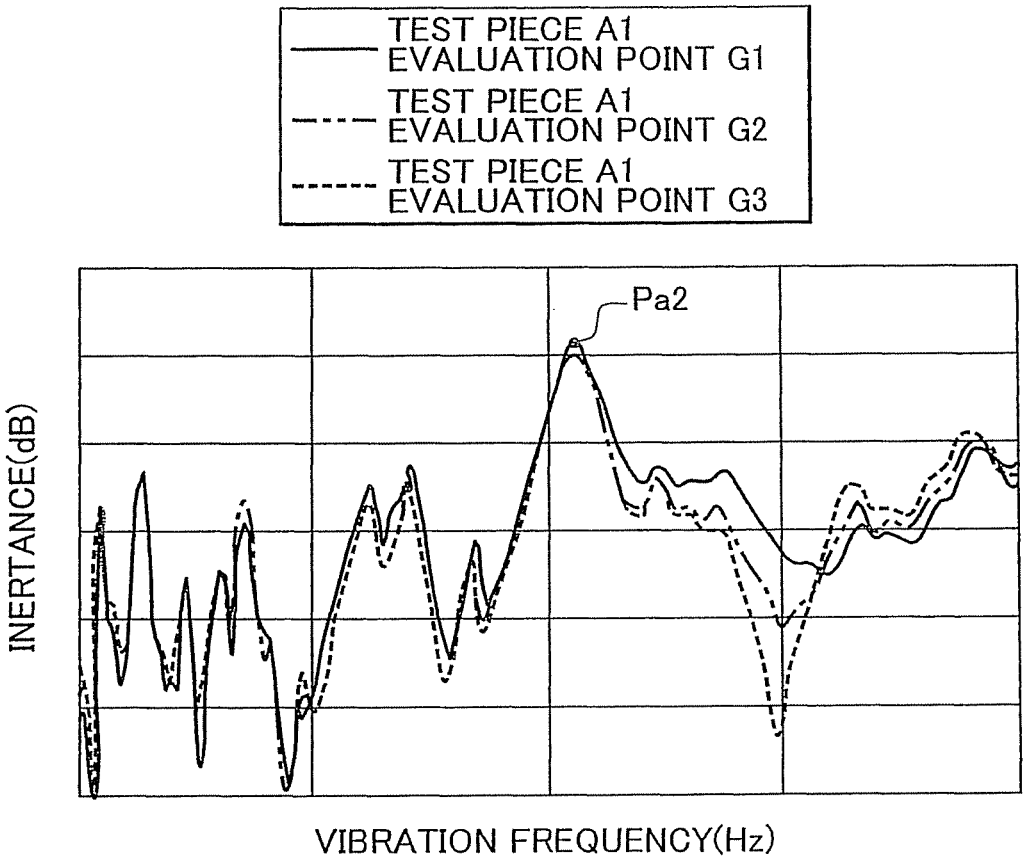
FIG. 12 is a graph that shows the inertances at evaluation points G1 to G3 of the test piece A1 in vibration tests.
Figure 13:
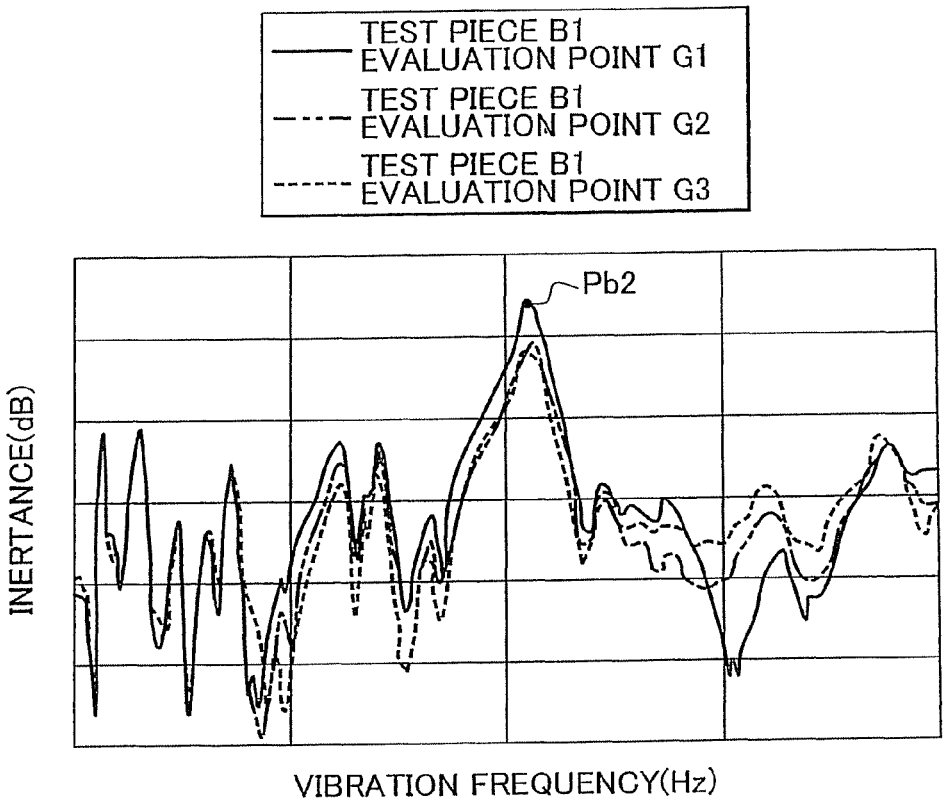
FIG. 13 is a graph that shows the inertances at evaluation points G1 to G3 of the test piece B1 in vibration tests.
Figure 14:
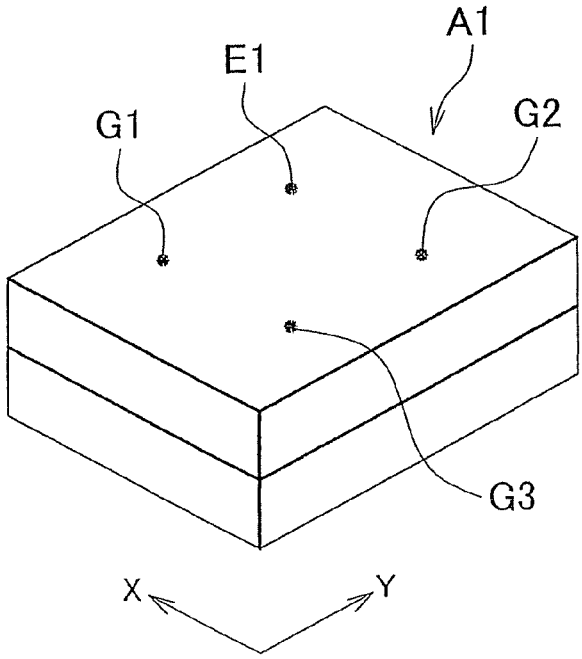
FIG. 14 is a view that illustrates the evaluation points G1 to G3 of the test piece A1.
Figure 15:
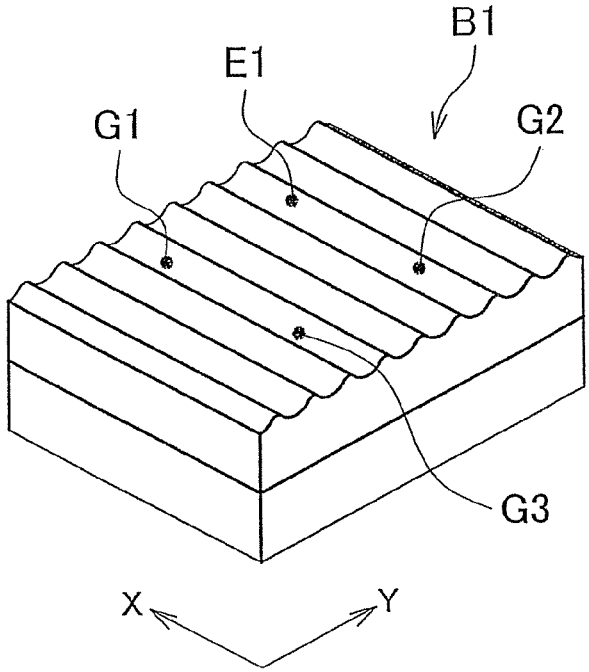
FIG. 15 is a view that illustrates the evaluation points G1 to G3 of the test piece B1.

In addition, FIG. 12 and FIG. 13 show the results of vibration tests that are conducted while the positional relationship between a vibration generating point and an inertance evaluation point is variously changed. FIG. 12 shows the evaluation results of inertance in the test piece A1 at an evaluation point G1 set at a position that is displaced from a vibration generating point E1 in the Y direction (direction in which the nozzle unit 10 is moved at the time of applying damping material), an evaluation point G2 set at a position that is displaced from the vibration generating point E1 in the X direction, and an evaluation point G3 set at a position that is displaced from the vibration generating point E1 in the X direction and in the Y direction, as shown in FIG. 14. In addition, FIG. 13 shows the evaluation results of inertance in the test piece B1 at an evaluation point G1 set at a position that is displaced from a vibration generating point E1 in the Y direction (direction transverse to the wavy shape of the surface), an evaluation point G2 set at a position that is displaced from the vibration generating point E1 in the X direction (direction along the wavy shape of the surface), and an evaluation point G3 set at a position that is displaced from the vibration generating point E1 in the X direction and in the Y direction, as shown in FIG. 15. As is apparent through a comparison between FIG. 12 and FIG. 13, the test piece A1 has a smaller difference in inertance caused by a difference in evaluation point than that of the test piece B1. Therefore, the peak value Pa2 of FIG. 12 is smaller by about 2.0 dB than the peak value Pb2 of FIG. 13. In this way, the damping material layer A formed by the damping material application apparatus 80 according to the present embodiment has small variations in vibration damping performance, which occur depending on a direction in which vibrations are applied, and, as a result, has improved vibration damping performance of the damping material layer. This is presumably because the surface shape of the damping material layer A is uniform and anisotropy is extremely small.

The embodiment is described above. Note that in the damping material application apparatus 80 according to the above described embodiment, the control target values remain unchanged during application of damping material. Instead, control target values may be changed during application of damping material. For example, it is applicable that a thickness measuring device that measures the thickness of applied damping material is added to the nozzle unit 10 and then the control target value of the slit width of the discharge port 12*e* is changed on the basis of a difference between the measured thickness and the target thickness. The thickness measuring device may be a laser rangefinder, or the like. The laser rangefinder is added to the nozzle unit 10, a distance to the work piece 90 is measured in advance by the laser rangefinder, and then a distance to the surface of damping material is measured by the laser rangefinder at the time of applying damping material. By so doing, the thickness of applied damping material may be measured. In addition, when the laser rangefinder is added to the nozzle unit 10, the thickness of damping material immediately after being applied by the nozzle unit 10 may be monitored. By regulating the control target value of the slit width T2 of the discharge port 12*e* so that the measured thickness of damping material coincides with the target thickness, it is possible to apply damping material at a further uniform thickness. In addition, the control target values of the travel speed V1 and/or the discharge speed V2 of damping material may be changed so that the thickness of measured damping material coincides with the target thickness.

In addition, in the above described embodiment, damping material is applied while the nozzle unit 10 is being moved in the Y direction; however, as long as the nozzle unit 10 and the work piece 90 are moved with respect to each other in the Y direction, any one of the nozzle unit 10 and the work piece 90 may be moved. In addition, both the nozzle unit 10 and the work piece 90 may be moved.

Specific examples of the invention are described in detail above; however, these are only illustrative and do not limit the scope of the appended claims. The technique recited in the appended claims encompasses various modifications, alterations and improvements of the above described specific examples. The technical elements described in the specification and the drawings exhibit technical utility alone or in various combinations and are not limited to the combinations described in the appended claims. In addition, the technique described in the specification and the drawings achieves multiple purposes at the same time, and it also has technical utility by achieving one of those purposes.

The invention claimed is:

1. A nozzle unit for applying damping material onto a work piece, comprising:

a nozzle formed of a first case and a second case that is fixed to the first case, the first case having a feeding port and a discharge port which has a slit shape, the nozzle discharging the damping material from the discharge port;

a motor that is fixed to the second case; and a slit width changing device that changes a slit width of the discharge port using rotation of the motor, and a rotation transmitting device, wherein:

the motor is arranged in such an orientation that a first rotary shaft of the motor is aligned in a discharging direction in which the damping material is discharged from the nozzle;

the rotation transmitting device transmits rotation of the first rotary shaft to a second rotary shaft that extends toward the nozzle;

the slit width changing device changes the slit width of the discharge port in accordance with rotation of the second rotary shaft;

the second rotary shaft is formed of a first shaft, a second shaft and a connecting member;

the first shaft is connected to the rotation transmitting device;

the second shaft is connected to the first shaft via the connecting member so that the second shaft is slidable in an axial direction with respect to the first shaft and the second shaft is not rotatable with respect to the first shaft;

the second shaft is inserted in a threaded hole formed in the second case, a threaded portion is formed on a part of a side surface of the second shaft, the threaded portion is engaged with the threaded hole, a distal end of the second shaft is engaged with the slit width changing device, the feeding port is formed at a first end of the first case the discharge port is formed at a second end of the first case opposite to the first end, and the motor is arranged at a side of the feeding port with respect to the discharge port in the discharging direction.

2. The nozzle unit according to claim 1, wherein the rotation transmitting device transmits rotation of the first rotary shaft to the second rotary shaft so that a rotational speed of the second rotary shaft is lower than a rotational speed of the first rotary shaft.

* * * * *

UNITED STATES PATENT AND TRADEMARK OFFICE

CERTIFICATE OF CORRECTION

PATENT NO. : 8,814,065 B2
APPLICATION NO. : 13/322216
DATED : August 26, 2014
INVENTOR(S) : Yoshihiro Iwano et al.

It is certified that error appears in the above-identified patent and that said Letters Patent is hereby corrected as shown below:

In the Specification

At column 2, line 30, change “to a damping,” to -- to a damping --.

At column 3, line 64, change “a damping material,” to -- a damping material --.

At column 5, line 50, change “material, feeding” to -- material feeding --.

At column 7, line 46, change “V1 V2. Furthermore,” to -- V1≥V2. Furthermore, --.

Signed and Sealed this
Fifth Day of May, 2015

Michelle K. Lee

Michelle K. Lee
*Director of the United States Patent and Trademark Office*